United States Patent [19]

Read

[11] 4,358,680

[45] Nov. 9, 1982

[54] CHARGED PARTICLE SPECTROMETERS

[75] Inventor: Frank H. Read, Macclesfield, England

[73] Assignee: Kratos Limited, Urmston, England

[21] Appl. No.: 210,825

[22] Filed: Nov. 26, 1980

[30] Foreign Application Priority Data

Nov. 30, 1979 [GB] United Kingdom ..... 7942332
Nov. 30, 1979 [GB] United Kingdom ..... 7941333

[51] Int. Cl.[3] ..... H01J 40/00
[52] U.S. Cl. ..... 250/305
[58] Field of Search ..... 250/305, 396, 397

[56] References Cited

U.S. PATENT DOCUMENTS 3,617,741 11/1971 Siegbahn ..... 250/305
3,733,483 5/1973 Green et al. ..... 250/305
3,777,159 12/1973 Hammond et al. ..... 250/305

FOREIGN PATENT DOCUMENTS 1303136 1/1973 United Kingdom ..... 250/305
1332207 10/1973 United Kingdom ..... 250/305

*Primary Examiner*—Bruce C. Anderson
*Attorney, Agent, or Firm*—Leydig, Voit, Osann, Mayer & Holt Ltd.

[57] ABSTRACT

An electron spectrometer includes a hemispherical analyzer and a multi-element optical lens system. The lens system has, at its entrance, two spaced apart mesh elements which are concave toward the sample, for reducing the lens aberrations, and switching means operable to change the potentials on the lens elements to optimize the performance of the spectrometer for both Auger Electron Spectrometry and X-ray Spectrometry.

9 Claims, 4 Drawing Figures

CHARGED PARTICLE SPECTROMETERS

BACKGROUND OF THE INVENTION

This invention relates to electron spectrometers, in particular for the surface analysis of a sample.

Hitherto, electron spectrometers in surface analysis instrumentation have been of two main types. The first type namely the hemispherical analyzer (HSA), has been employed primarily in X-ray photoelectron spectroscopy (XPS), where the primary irradiation, namely X-rays, was used to bombard and release electrons from a relatively large area of sample, typically 0.1–1 square centimeter, and it was necessary to provide means to collect the released electrons from this relatively large area and deliver the collected electrons to the analyzer. For this purpose an electron lens system has generally been employed, in a position between the sample under examination and the analyzer, in a mode which essentially could be described as one of collimating electrons ejected from the whole irradiated area and focusing these to a point which was at the entrance of the analyzer.

The second type, namely the cylindrical mirror analyzer (CMA), has hitherto been employed in Auger electron spectroscopy (AES) particularly in applications where the source of irradiation, namely electrons, was focused on to small areas of the sample of the order of 1 square micron or even less. In this application the geometrical arrangement of the electron gun used as the source of the primary irradiation enabled electrons ejected from the small irradiated area to be collected over a large solid angle, typically 0.5 steradians, and thus maximise sensitivity in this mode of operation.

The HSA could be used for high spatial resolution AES but hitherto had the disadvantage of low sensitivity, because the input lenses to the HSA were, as described above, essentially collimators and useful only to collect electrons over small angles, for example less than 5° half-angle.

Similarly the CMA could be used for XPS applications, but again the geometry was such that it was impossible to obtain maximum resolution in this mode whilst maintaining the high collection efficiency of the system required for high spatial resolution AES.

In previous practice, electron spectrometers have been used as described for example in British Patent Specification No. 1,332,207 comprising a hemispherical analyzer, means for irradiating a sample located in a sample position to cause electrons to be emitted therefrom, an electron optical lens system which includes a plurality of elements for receiving the electrons emitted from the sample and delivering the received electrons to the analyzer, a detector connected to the analyzer to detect analyzed electrons and energized means for applying potentials to the elements such that electrons which are ejected from a restricted selected area of the sample are brought to a focus by the lens system.

BRIEF SUMMARY OF THE INVENTION

With the increasing requirement in surface analysis instrumentation to examine samples sequentially in the same apparatus by both XPS and high resolution AES, there developed a requirement for a system which could operate at high sensitivity in both modes.

This is achieved, in accordance with the invention, in that the electron optical lens system includes at least two spaced apart mesh elements at the entry to the lens system, the mesh elements being concave toward the sample position and that the energized means are operable in a first mode to apply a first set of potentials to the elements such as to retard electrons passing between the mesh elements to effect refraction of the electrons and permit collection of the electrons from said selected area and in a second mode to apply a second set of potentials to the lens elements so as to accept electrons from an irradiated area which is many times larger than the selected area, and means for switching the potentials on the lens elements to switch the spectrometer between different modes of operation without mechanical modification of the lens elements.

In particular, in the first mode, the electrons are collected over a cone of large half-angle, for example 25°–30°, and to provide high linear magnification, for example in the range of 3 to 20 and preferably 5 to 20.

Furthermore, the electron lens system include electron deflecting means and the energizing means is operable to apply potentials to the deflecting means to locate the selected area at any desired position on the sample within said larger area.

More particularly the energizing means can include lens scanning means to apply potentials, for example oscillating potentials, to move the selected area over the sample in a scanning operation to scan said larger area.

Again, the detector can include, or be provided with, averaging means so that a measurement can be obtained of the average yield of electrons of selected energy or energies from the examined larger area of the sample.

Thus, by operating a switch that changes the potentials of the various elements of the lens, the collection efficiency is optimised either for collection of electrons over a relatively large area, typically 0.1–1 square centimeters, for XPS, to one in which the collection of electrons over a small area of the order of 1 square millimeter or less over a cone of large half-angle, typically 25°–30° substantially without aberration, is optimised for AES, and/or one in which the small area is scanned over the sample, to determine average yield of electrons over the examined area of the sample, in AES or XPS modes. This permits, in a single apparatus, the examination of the sample by XPS and high spatial resolution AES at maximum efficiency in a way that was previously possible only by employing two analyzing systems. In addition, the scanned area can be made to remain constant whatever the energy of electrons is passed by the analyzer.

An additional feature of the system is that it permits the use of scanning techniques combined with one mode of operation of the input lens system so that electrons are collected from small areas, of the order of less than one square millimeter in XPS.

BRIEF DESCRIPTION OF THE DRAWINGS

The invention will now be particularly described with reference to the accompanying drawings in which.

DETAILED DESCRIPTION

Figure 1:
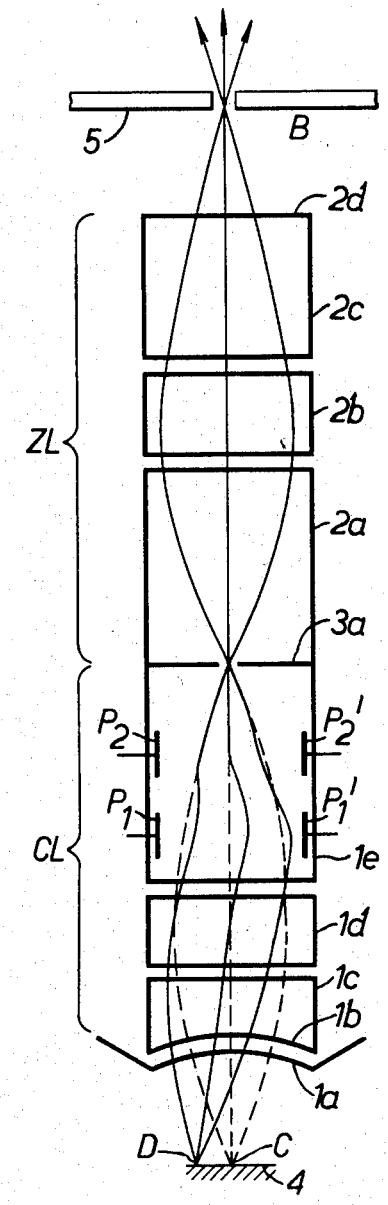
FIG. 1 is a diagrammatical axial section through a wide reception angle electron lens assembly forming part of a spectrometer in accordance with the invention, showing in dotted line the path of an axial beam of electrons, and in full line the path of a deflected beam of electrons.

The electron lens assembly shown in FIG. 1 comprises a first or aberration compensating lens CL, and a second or zoom lens ZL arranged in that order along the electron path. The first lens includes components 1*a* and 1*b*, both taking the form of partially transparent conductive meshes, their shapes being concave towards the sample and being for example, part-spherical surfaces the centres of curvature of which are situated between component 1*a* and the centre of the sample 4.

The lens assembly will be enclosed within a vacuum chamber, not shown, and component 1*a* of the lens assembly is held, for example, at the same potential as that of the sample and the vacuum chamber, which will be referred to as earth potential. Component 1*b*, which is at a potential either the same or different from that of component 1*a*, is electrically and mechanically connected to component 1*c*. The first lens CL further comprises components 1*d* and 1*e*. All these components, 1*c*, 1*d*, 1*e*, which are conveniently cylindrical, have axial symmetry about a common axis, this axis also containing the centres of curvature of components 1*a* and 1*b*. Lens CL is further provided with an electron deflection means which can be magnetic means or electrostatic means, in particular a plate assembly P. Conveniently the deflection plate assembly comprises, as shown in FIG. 1, two pairs of opposite plates $P_1,P_1'$ and $P_2,P_2'$; generally referred to below as deflection means P.

Between the first and second lenses is an aperture plate 3*a*, mounted within the cylinder 1*e*, which limits the extent of the beam and which may or may not have axial symmetry.

The second lens ZL comprises components 2*a*, 2*b* and 2*c*, all of which have axial symmetry about the common axis of components 1*c*, 1*d*, and 1*e*, and all of which generally have a different potential. Component 1*e* can be formed integrally with component 2*a*, the integral component thus being a common component of the first and the second lens. Component 2*c* has for example the same potential as a fringe field plate 5, located at the entrance of an electron energy analyzer to be described below. The end of component 2*c* carries an apertured plate 2*d*.

The first or aberration compensating lens CL has three modes of operation. In the first the potentials applied to the lens elements 1*a*, 1*b*, 1*c*, 1*d* and 1*e* are such that a magnified image of the electrons emitted from a small selected area of the sample, such as the areas C or D in FIG. 1, is focussed at or near the aperture in plate 3*a*, the position of the selected area being determined by the potentials applied to the deflection means P. For example, when no potentials are applied to the deflection means the selected area is coaxial with the lens elements, at the position C in FIG. 1, and the emitted electrons follow trajectories such as those indicated by broken lines in FIG. 1, but when suitable non-zero potentials are applied to the deflecting means the selected area is at a non-axial position, such as the position D in FIG. 1, and the emitted electrons follow trajectories such as those indicated by the full lines in FIG. 1. In this mode the lens elements 1*a* and 1*b* act to retard the electrons and to refract them towards the axis. The further elements 1*c*, 1*d* and 1*e* of lens CL act to focus the electron beam at or near the plane of plate 3*a*, and the deflection means acts to send the focussed beam through the aperture in plate 3*a* in an axial direction. The linear magnification of the image of plate 3*a* is typically in the range from 3 to 20, preferably 5 to 20, which is referred to herein as high magnification.

When the sample is suitably irradiated electrons are emitted in a wide range of directions. Only those electrons entering lens CL within a cone of limited solid angle will be brought to a focus; the remainder will strike the lens elements and be absorbed.

Two stages of deflection means, such as the two pairs of opposite plates $P_1,P_1'$ and $P_2,P_2'$ in FIG. 1, are required to bring the electrons emitted from an off-axis area of the sample, such as D in FIG. 1, to a condition at the plate 3*a* such that the electron beam has a position of focus at or near the aperture in plate 3*a* and also has a mean direction along the axis of the lens. The first deflection stage changes the angle of tilt to the lens axis of the bundle of trajectories of those electrons received from the off-axis area, while the second deflection stage further corrects the bundle of trajectories so that it becomes coaxial with the lens elements. The two stages of deflection produce a dog-leg path as shown by the full lines in FIG. 1. By varying the intensity of the deflection the selected area D can be moved towards or away from the axial area C in either direction.

Figure 2:
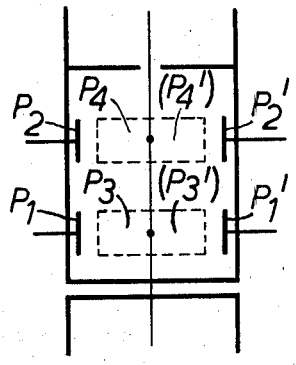
FIG. 2 shows, on an enlarged scale, part of the lens assembly of FIG. 1 illustrating the arrangement of deflection plates.
Figure 3:
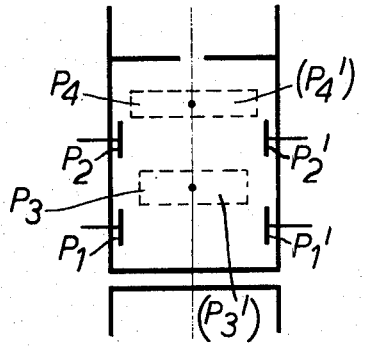
FIG. 3 is a view of the lens assembly corresponding to that of FIG. 2 illustrating an alternative arrangement of deflection plates and FIG. 4 is a schematic view of an electron spectrometer in accordance with the invention in which a sample is irradiated in a 'flood' technique.

By the provision of further deflector plates in planes at right-angles to those shown in FIG. 1, the selected area can be moved in a direction perpendicular to the plane of FIG. 1. The further deflector plates can comprise, as shown in FIG. 2, two opposite plates $P_3,P_3'$ in the same stage as plates $P_1,P_1'$, and two opposite plates $P_4,P_4'$ in the same stage as plates $P_2,P_2'$. Alternatively, as shown in FIG. 3, the further deflector plates can be located in one stage intermediate plates $P_1,P_1'$ and $P_2,P_2'$ and in another stage beyond plates $P_2,P_2'$.

The shapes, positions and potentials of the elements of lens CL in the first mode of operation are such that the lens has reduced spherical and other aberrations, thus allowing electrons emitted from the sample to be received in a cone of large half-angle, typically 25° to 30°, and yet be focussed to a spot of small size at or near the aperture in plate 3*a*. The aberrations resulting from collecting electrons over a wide angle are at least partially overcome by the use of the partially transparent conductive meshes of suitable shape and the application thereto of suitable potentials. In particular applications the required shapes and potentials of these meshes and of the other elements of the aberration-compensating lens can be determined by carrying out computer calculations of electron trajectories through the aberration-compensated lens for a variety of different shapes and potentials of the meshes and other elements, choosing those shapes and potentials which give the final image having the smallest aberrations. Alternatively, the required shapes and potentials of the meshes and other lens elements can be determined by carrying out experimental measurements of the aberrations of the final image for a wide variety of different shapes and potentials.

All lenses composed only of cylindrically symmetric elements which do not pass through the axis have aberrations which are usually large and which cannot be made zero, whereas with meshes the possibility of making some of aberrations zero exists. Moreover by the use of concave meshes having a retarding field between them, electrons emitted over a wide range of angles (for example up to +30°) are collected and converged to a nearly parallel beam which is then more easily handled by the following lenses.

While retaining the condition for aberration compensation, the potentials of the elements of lens CL can be varied to alter the kinetic energy with which the electrons reach the aperture in plate 3*a*. The focussing action of the lens is maintained over this range by applying to the element 1*d* the potential appropriate to the change in kinetic energy. The possible range of values for the ratio of the kinetic energy of the focussed electrons at the aperture in plate 3*a* to the kinetic energy of the same electrons on being emitted from the sample is typically from 1/50 to ½.

In this first mode of operation the location of the selected area from which emitted electrons are being received, such as D in FIG. 1, is determined by the deflection means, such as the plates $P_1,P_1'$, $P_2,P_2'$ in FIG. 1. Thus when the whole area of the sample is continuously irradiated this first mode of operation enables emitted electrons to be received over a cone of large half-angle from a limited area of adjustable location, thus allowing limited portions of the sample to be studied in turn. On the other hand when a limited area of the sample is irradiated, the irradiated area being possibly scanned in a raster motion, this first mode of operation enables the area from which electrons are received with high efficiency to be made coincident or nearly coincident with the area being irradiated, by causing the deflection means to be appropriately energised synchronously with the irradiation means, thus increasing the yield of received electrons.

In the second mode of operation of the aberration compensating lens CL the potentials applied to the lens elements are the same as in the first mode, but oscillatory potentials are applied to the deflection means so as to cause the selected area, such as D in FIG. 1, to scan a defined area which is larger than that of D but which is smaller than that of a continuously irradiated area of the sample. The number of electrons which are emitted during the time of one complete scan of the defined area, received by the analyzer and then received by the detection system is averaged over the time of the scan, so that the detected yield of electrons of selected energy or energies corresponds to an average electron emitting power of the sample over the defined area for electrons of said energy or energies. By changing the amplitude and mean value of the oscillatory potentials applied to the deflection means the location of the boundaries of the defined area and of its centre can be adjusted and selected, and furthermore the location of the boundaries and centre can be arranged to be independent of the initial energy of the electrons that are emitted, received and detected. The waveform of the oscillatory potential, for example sinusoidal or saw-tooth, is appropriately chosen so that the detected yield of electrons corresponds to a uniform, or if desired a non-uniform, average of the electron emitting power over the defined area.

In this second mode of operation the form and amplitude of the oscillator potentials applied to the deflection means may be selected also to give a yield of detector electrons which corresponds to an average electron emitting power over the whole of the irradiated area of the sample.

In the third mode of operation of the aberration compensating lens CL a different set of potentials is applied to the lens elements 1*a*, 1*b*, 1*c*, 1*d* and 1*e*, and a zero potential is applied to the deflection means, such that an image of the electrons emitted from the whole of an irradiated area of the sample, such as would include the areas C and D in FIG. 1, is focussed at or near the aperture in plate 3*a*. In this mode the elements 1*a*, 1*b*, 1*c* and 1*d* are usually substantially at the same potential, and the elements 1*d* and 1*e* act to retard the electrons and to focus the electron beam at or near the said aperture. The ratio of the kinetic energy of the focussed electrons to the kinetic energy of the same electrons on being emitted from the sample is typically from 1/30 to 1/10. In this mode of operation the linear magnification of the image at plate 3*a* is approximately unity or less, being typically in the range from 3/2 to ½, and the half-angle of the cone over which the emitted electrons are received from each part of the irradiated area of the sample is correspondingly reduced in value, being typically in the range from 10° to 1°. The lens is thus acting as a collimator.

The potentials on the lens elements and deflection means are provided by energizing circuits that form no part of the present invention, but include switching means which enable the potentials applied to the different lens elements to be changed. The lens CL is switched between its different modes of operation by appropriate operation of the switching means of the energizing circuits, without the need for mechanical modification of the lens elements.

The second or zoom lens ZL receives the electron image at or near the aperture in plate 3*a* and forms a focussed image at or near the aperture in plate 5, which is at the entrance to an electron energy analyzer. The element 2*a* is at the same potential as that of the element 1*e* of lens CL and the plate 3*a*. The element 2*d* has a potential which is typically equal or approximately equal to that of the plate 5. The retarding ratio, that is the ratio of the kinetic energy of the received electrons at the plate 3*a* to the kinetic energy of the same electrons at the plate 5, is continuously variable over a range of values which is typically from 5 to 1/5. The focussing action of the lens is maintained over this range by applying to the element 2*b* the potential appropriate to the retarding ratio.

The combined system of lens CL plus lens ZL is usually operated in one of two modes. The first of these is described as the Fixed Analyzer Transmission, (FAT), mode. In this the emitted electrons which it is desired to study, having the initial kinetic energy $E_i$ on being emitted from the sample, are focussed at the plate 5 by the lens assembly as already described, and are brought at the plate 5 to a constant predetermined kinetic energy $E_a$ which the analyzer is set to pass. The potentials applied to the lens elements are therefore such as to result in the focussing action already described, and at the same time to give the required change in kinetic energy from $E_i$ to $E_a$. When it is desired to scan the range of possible energies $E_i$ of the emitted electrons, the potentials applied to the lens elements must be synchronously and appropriately adjusted to maintain the focussing conditions and to maintain the electron kinetic energy at plate 5 at the value $E_a$.

The second mode of the combined system of lens CL plus lens ZL is described as the Fixed Retarding Ratio (FRR), mode. In this the emitted electrons which it is desired to study, having the initial kinetic energy $E_i$, are focussed at plate 5 as already described, and are brought at plate 5 to a kinetic energy $E_a$ which is a constant predetermined fraction 1/R of $E_i$. The potentials applied to the lens elements and to the analyzer elements are such as to result in the focussing action already described, and at the same time to give the required ratio R between E and $E_a$ to allow the electrons of energy $E_a$ to pass through the analyzer. When it is desired to scan the range of possible energies $E_i$ of the emitted electrons, the potentials applied to the lens elements and analyzer elements must be synchronously and appropriately adjusted to maintain the focussing conditions, the ratio R and the analyzer pass conditions.

It is possible also to operate the lens CL alone in the FAT or FRR modes, without the presence of lens ZL between lens CL and the analyzer, but there is then a reduction in the range of energies $E_a$ that the received and focussed electrons can have at the entrance to the analyzer, and hence a reduction in the range of electron energy resolutions at which the analyzer can operate.

Figure 4:
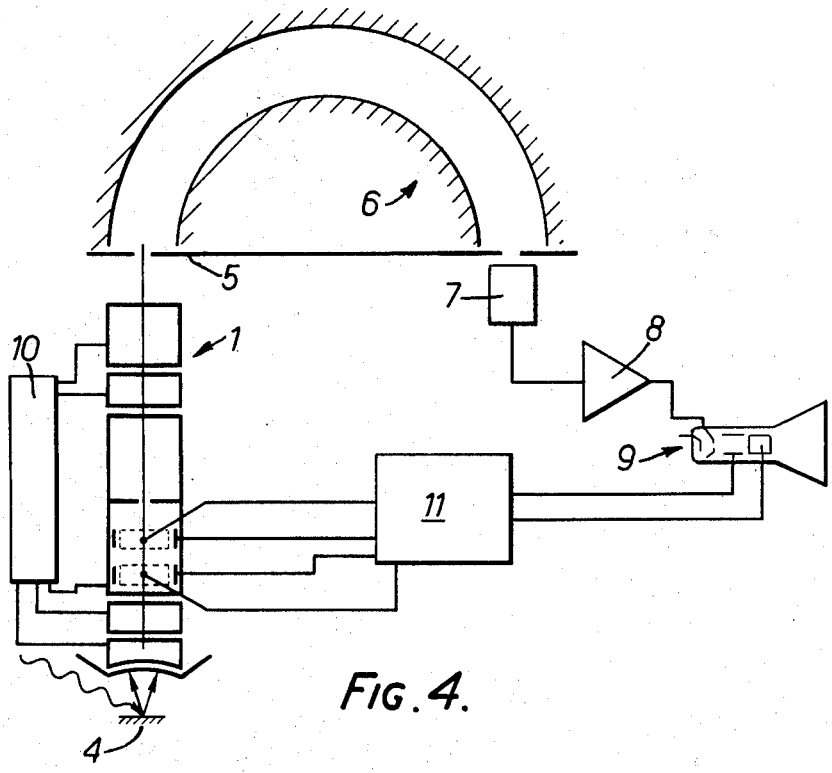

FIG. 4 illustrates diagrammatically the full spectrometer which comprises the lens assembly 1, an electron-energy hemispherical analyzer 6 having the fringe plate 5 at its entrance and exit, an electron detector 7 located at the outlet of the analyzer, an amplifier 8 and a display device 9. The display device 9 is conveniently a cathode ray tube connected to the detector via the amplifier so that the CRT display is intensity-modulated or deflection-modulated by the output signal from the detector. Alternatively, the display device 9 is an X-Y recorder, the Y input of which is connected to the detector via the amplifier and the X input of which is scanned synchronously with the energizing means for scanning the energy $E_i$ of the emitted electrons that are received and detected. The detector 7 will include, or be connected to, means for measuring the average number of electrons received during any one or more scans of the sample. The analyzer shown is an electrostatic hemispherical deflection analyzer but alternatively it may be of another electrostatic or magnetic type.

An energizing circuit 10 is connected to the lens components to apply suitable potentials thereto, and a scan generator 11 is connected to the deflector plate assembly P, so as to apply suitable time dependent electrical waveforms to the plates to scan the selected area D over the sample as required. The scan generator 11 may be controlled by the energizing circuit 10, to enable the deflection means to be varied synchronously with the energizing means for scanning the energy $E_i$ of the emitted electrons that are received and detected. Alternatively, the scan generator may also be connected to deflector plates *9a, 9b* of the cathode ray tube 9 to scan the display in synchronism with the scan of the lens deflector plates P, as desired.

It is often found that when carrying out the analysis of a sample by the use of a spectrometer having a hemispherical electrostatic analyzer as in the spectrometer described above, or a cylindrical mirror energy analyzer (CMA), if large areas are examined by scanning a finely focussed irradiating beam over the sample, the outer parts of the scanned area are not focussed up by an analyzer fed by a conventional high magnification lens. Both types of spectrometer can only scan areas of a few hundred microns without going out of focus or suffering from serious intensity losses. This is because the Auger electron emitting area of the sample, which is the area bombarded by the irradiating beam, is not wholly on the axis of the lens. However, by use of a lens deflection system as described above, it is possible to bring the electron trajectories from such an off-axis emitting area back on to the lens axis, and by scanning both the lens and the irradiating beam in synchronism over the sample, a high yield of electrons is provided in a focused beam at the entrance to the analyzer.

Although reference is made herein to a hemispherical analyzer, this term is intended to cover not only those of 180°, but of other sections of a full sphere, for example 120° to 180°.

I claim:

1. An electron spectrometer comprising a hemispherical analyzer, means for irradiating a sample located in a sample position to cause electrons to be emitted therefrom, an electron optical lens system which includes a plurality of lens elements and electron deflection elements defining at least two stages of deflection for receiving the electrons emitted from any desired position on the sample and delivering the received electrons to the analyzer, a detector connected to the analyzer to detect analyzed electrons and energizing means for applying potentials to the elements such that electrons which are ejected from a restricted selected area of the sample are brought to a focus by the lens system, and wherein the electron optical lens system includes at least two spaced apart mesh elements at the entry to the lens system, the mesh elements being concave toward the sample position so that aberrations of the lens system can be reduced and the energizing means in a first mode apply a first set of potentials to the lens elements and deflection elements such as to retard electrons passing between the mesh elements to effect refraction of the electrons in such a way as to minimise the aberrations of the lens system and permit collection of the electrons emitted over a wide acceptance angle from a selected area of small dimensions (viz. less than one square millimeter) and at any desired position on the sample and to provide high magnification, and in a second mode apply a second set of potentials to the lens elements and deflection elements so as to accept electrons from an irradiated area which is many times larger than for the first mode, and means for switching the potentials on the lens elements and on the deflection elements to switch the spectrometer between different modes of operation without mechanical modification of the lens elements.

2. An electron spectrometer according to claim 1 characterised in that the energizing means includes lens scanning means to apply time-varying potentials to the deflecting means to move the selected area over the sample in a scanning operation.

3. An electron spectrometer according to claim 2 characterised in that the energizing means is operable to bring electrons of a selected energy or energy band to a focus at the analyzer and by varying the potentials on the lens elements to change the selected energy or energy band of the focussed electrons.

4. An electron spectrometer according to claim 2 or claim 3 characterised in that the lens scanning means is operable to apply oscillatory potentials to the deflection means to permit continuous scanning of the sample and cause electrons to be accepted from an area which is larger than the said selected area and which can be kept substantially constant as the initial energy of the electrons which are emitted from the sample and received by the analyzer is varied.

5. A spectrometer according to claim 2 characterised in that the means for irradiating the sample is operative to irradiate only the selected area or a restricted area of the sample including the selected area, and to scan the sample in synchronism with the scanning means.

6. A spectrometer according to claim 5 characterised in that the irradiating means irradiates at any moment the whole of the area of the sample scanned by the lens.

7. A spectrometer according to claim 5 or claim 6 characterised by a display system connected to said detector so that the display is intensity-modulated or deflection-modulated by the output of the detector, and means for scanning the display in synchronism with the lens scanning means.

8. A spectrometer according to claim 5 characterised in that amplitude of the scanning means is variable to move inwardly or outwardly the boundaries of the area of the sample, over which the selected area is scanned and so vary the magnitude of the scanned area.

9. A spectrometer according to claim 5 or claim 8 characterised in that means are provided for averaging the signal from the detector over the total area scanned during one or more scanning cycles.

* * * * *

UNITED STATES PATENT AND TRADEMARK OFFICE

CERTIFICATE OF CORRECTION

PATENT NO. : 4,358,680

DATED : November 9, 1982

INVENTOR(S) : Read, Frank H.

It is certified that error appears in the above—identified patent and that said Letters Patent is hereby corrected as shown below:

Column 5, line 4, change "to + 30°" to read

-- to ± 30° --.

Signed and Sealed this

*Twenty-second* Day of *February 1983*

[SEAL]

*Attest:*

GERALD J. MOSSINGHOFF

*Attesting Officer*

*Commissioner of Patents and Trademarks*